US009556827B2

(12) United States Patent
Iwaya et al.

(10) Patent No.: US 9,556,827 B2
(45) Date of Patent: Jan. 31, 2017

(54) FUEL TANK SYSTEM

(71) Applicant: MITSUBISHI JIDOSHA KOGYO KABUSHIKI KAISHA, Tokyo (JP)

(72) Inventors: Norifumi Iwaya, Obu (JP); Atsushi Wakamatsu, Okazaki (JP); Takayuki Sano, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 357 days.

(21) Appl. No.: 14/468,855

(22) Filed: Aug. 26, 2014

(65) Prior Publication Data

US 2015/0059870 A1 Mar. 5, 2015

(30) Foreign Application Priority Data

Aug. 28, 2013 (JP) ..... 2013-176692

(51) Int. Cl.
*F02M 25/08* (2006.01)
*F02M 37/00* (2006.01)

(52) U.S. Cl.
CPC ..... *F02M 25/0809* (2013.01); *F02M 25/089* (2013.01); *F02M 37/0076* (2013.01); *Y10T 137/6881* (2015.04)

(58) Field of Classification Search
CPC ..... F02M 25/08; F02M 25/0809
USPC ..... 123/516, 518–520
See application file for complete search history.

(56) References Cited

U.S. PATENT DOCUMENTS 5,143,035 A * 9/1992 Kayanuma ..... F02M 25/0809 123/198 D
5,182,945 A * 2/1993 Setter ..... F02M 25/0809 73/114.39
5,269,277 A * 12/1993 Kuroda ..... F02M 25/0809 123/198 D
5,284,121 A * 2/1994 Abe ..... F02M 25/0836 123/198 D (Continued)

FOREIGN PATENT DOCUMENTS

JP 7-91332 A 4/1995
JP 2005-53376 A 3/2005

(Continued)

OTHER PUBLICATIONS

Japanese Office Action for Japanese Application No. 2013-176692, dated Jan. 14, 2014.

*Primary Examiner* — Thomas Moulis
(74) *Attorney, Agent, or Firm* — Birch, Stewart, Kolasch & Birch, LLP

(57) ABSTRACT

A first pressure sensor capable of detecting pressure in a narrow pressure range with a high accuracy to detect internal pressure in the fuel tank is arranged in the fuel tank, and a second pressure sensor that is capable of detecting pressure in a wide pressure range with a low accuracy with respect to the first pressure sensor, and is capable of detecting internal pressure of the fuel tank, is arranged in vapor piping between the fuel tank and a tank blocking valve. When a filler lid switch is operated to release internal pressure of the fuel tank, the first pressure sensor detects internal pressure of the fuel tank so that an operation of the tank blocking valve is controlled on the basis of the detection result, and then a filler lid is opened when the internal pressure of the fuel tank becomes the atmospheric pressure.

12 Claims, 4 Drawing Sheets

(56) References Cited

U.S. PATENT DOCUMENTS 5,295,472 A * 3/1994 Otsuka ..... F02M 25/0809 123/198 D
5,501,198 A * 3/1996 Koyama ..... F02M 25/0809 123/198 D
5,542,396 A * 8/1996 Moz ..... F02M 25/08 123/520
5,918,581 A * 7/1999 Uto ..... F02M 25/08 123/198 D
6,463,965 B1 * 10/2002 Rasche ..... B60K 15/03504 123/519
6,983,739 B2 * 1/2006 Suzuki ..... F02M 25/0818 123/519
9,441,579 B2 * 9/2016 Iwaya ..... F02M 25/0836
2006/0016252 A1 * 1/2006 Iriyama ..... F02M 25/0809 73/114.39
2010/0288021 A1 * 11/2010 Makino ..... F02M 25/0836 73/40.7
2011/0011472 A1 * 1/2011 Mc Lain ..... F02M 25/0809 137/624.12
2011/0166765 A1 * 7/2011 DeBastos ..... B60K 15/03504 701/102
2011/0168140 A1 * 7/2011 DeBastos ..... F02M 25/0818 123/521
2011/0197862 A1 * 8/2011 Der Manuelian .. F02M 25/0809 123/521
2011/0284781 A1 * 11/2011 Keller ..... F02M 25/0836 251/129.15
2011/0308302 A1 * 12/2011 Makino ..... F02M 25/0836 73/40.7
2012/0186333 A1 * 7/2012 Nishimura ..... F02M 25/0809 73/40.5 R
2013/0104858 A1 5/2013 Iwaya et al.
2014/0107906 A1 * 4/2014 Jentz ..... F02M 37/0088 701/102
2014/0374177 A1 * 12/2014 Yang ..... B60K 15/035 180/65.21
2015/0101689 A1 * 4/2015 Balsdon ..... F02M 25/0818 137/551
2015/0198123 A1 * 7/2015 Pearce ..... B60K 15/03504 123/520

FOREIGN PATENT DOCUMENTS

JP 2011-185227 A 9/2011
JP 2013-092135 A 5/2013

* cited by examiner

FUEL TANK SYSTEM

BACKGROUND OF THE INVENTION

Field of the Invention

The present invention relates to a fuel tank system, and more particularly to pressure detection structure in a closed type fuel tank.

Description of the Related Art

In a conventional fuel tank system, there is a technique for preventing release of a fuel evaporative emission formed by evaporation in a fuel tank into the atmosphere, in which a sealing valve (hereinafter referred to as a tank blocking valve), which is controlled so as to close the fuel tank, is provided in a path allowing the fuel tank to communicate with a canister. The tank blocking valve is opened at the time of filling so that the fuel evaporative emission is allowed to flow to the canister, thereby allowing the canister to absorb the fuel evaporative emission.

In such a fuel tank system, if the fuel tank is closed by the tank blocking valve, fuel in the fuel tank evaporates with a rise in outside air temperature, so that pressure in the fuel tank, or fuel tank internal pressure, may become high due to a fuel evaporative emission.

Japanese Patent Laid-Open No. 2013-92135, for example, describes a fuel evaporative emission preventing device, in which a pressure sensor is provided in a fuel tank to monitor fuel tank internal pressure, and if a fuel tank internal pressure becomes high while an engine is operating, a tank blocking valve is opened to allow a fuel evaporative emission in the fuel tank to flow into an air intake passage of the engine so that the fuel tank internal pressure is reduced.

In the fuel evaporative emission preventing device, a pressure sensor for detecting the fuel tank internal pressure is provided in a fuel tank to control an operation of a tank blocking valve on the basis of a detection value obtained by the pressure sensor.

Unfortunately, if abnormality occurs in the pressure sensor, there is a possibility that pressure in a fuel tank cannot be accurately detected so that a lid of a filling opening cannot be properly opened.

SUMMARY OF THE INVENTION

The present invention has been made to solve the problem described above, and an object of the present invention is to provide a fuel tank system capable of detecting abnormality in a pressure sensor with a simple structure.

In order to achieve the object above, the invention of the present application is a fuel tank system that comprises: a fuel tank mounted on a vehicle; a first pressure detector arranged in the fuel tank to detect pressure in the fuel tank; a second pressure detector arranged in a position different from the position of the first pressure detector to detect pressure in the fuel tank; and an abnormality determination part that determines abnormality in the first pressure detector or the second pressure detector on the basis of a detection result obtained by the first pressure detector and a detection result obtained by the second pressure detector.

Accordingly, since the first pressure detector for detecting pressure in the fuel tank is arranged in the fuel tank and the second pressure detector for detecting pressure in the fuel tank is arranged in a position different from the position of the first pressure detector, each of the first pressure detector and the second pressure detector detects pressure in the fuel tank in a case where pressure in the fuel tank is released when a filling opening of the fuel tank is opened in a case of filling etc., for example. As a result, it is possible to detect abnormality in the pressure detector with a simple structure by determining abnormality in the first pressure detector or the second pressure detector on the basis of the detection result.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE PREFERRED EMBODIMENT

The fuel tank system of the present invention will be described on the basis of the accompanying drawings.

Figure 1:
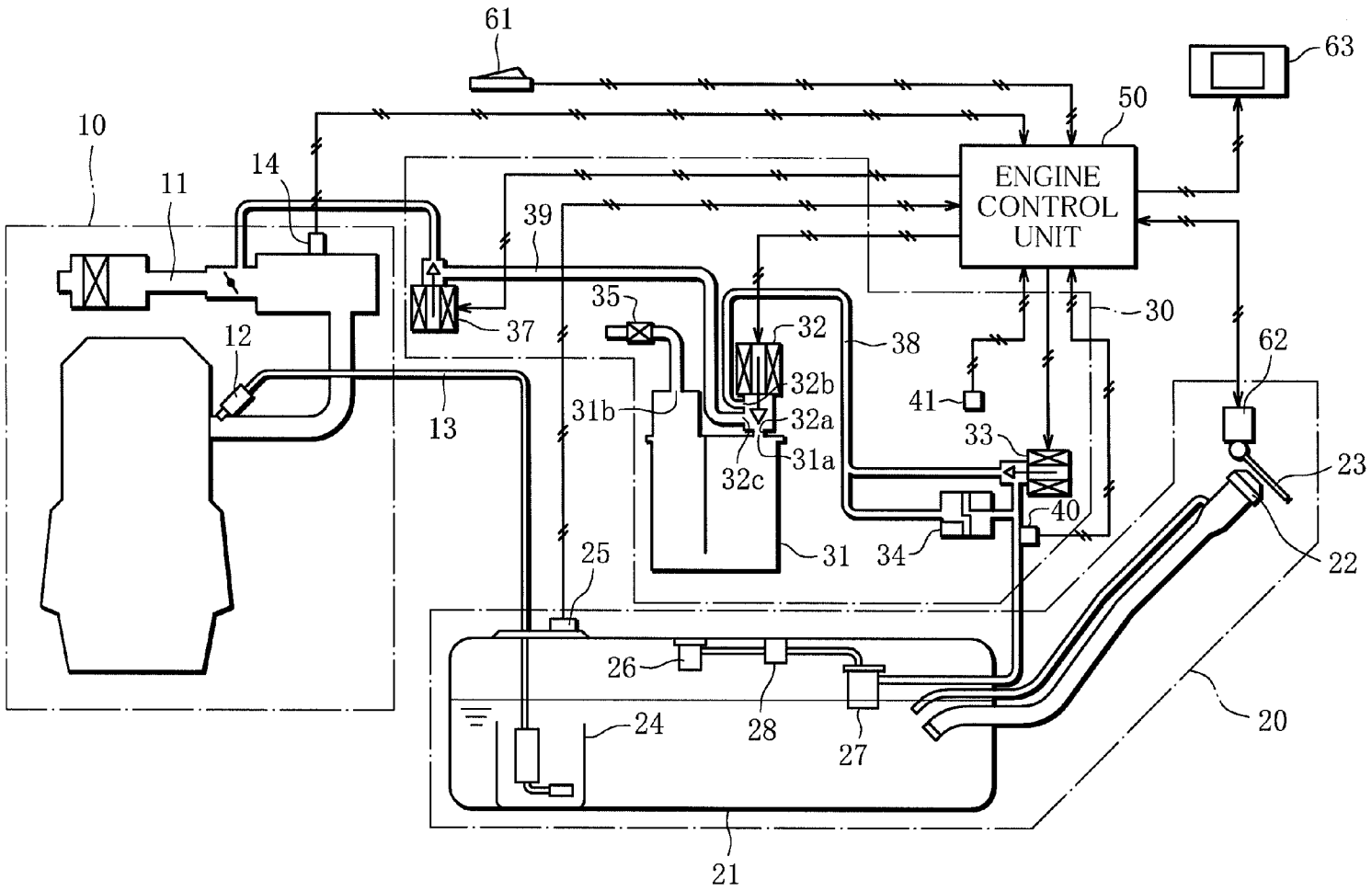
FIG. 1 is a schematic configuration diagram of a fuel tank system in accordance with the present invention.
Figure 2:
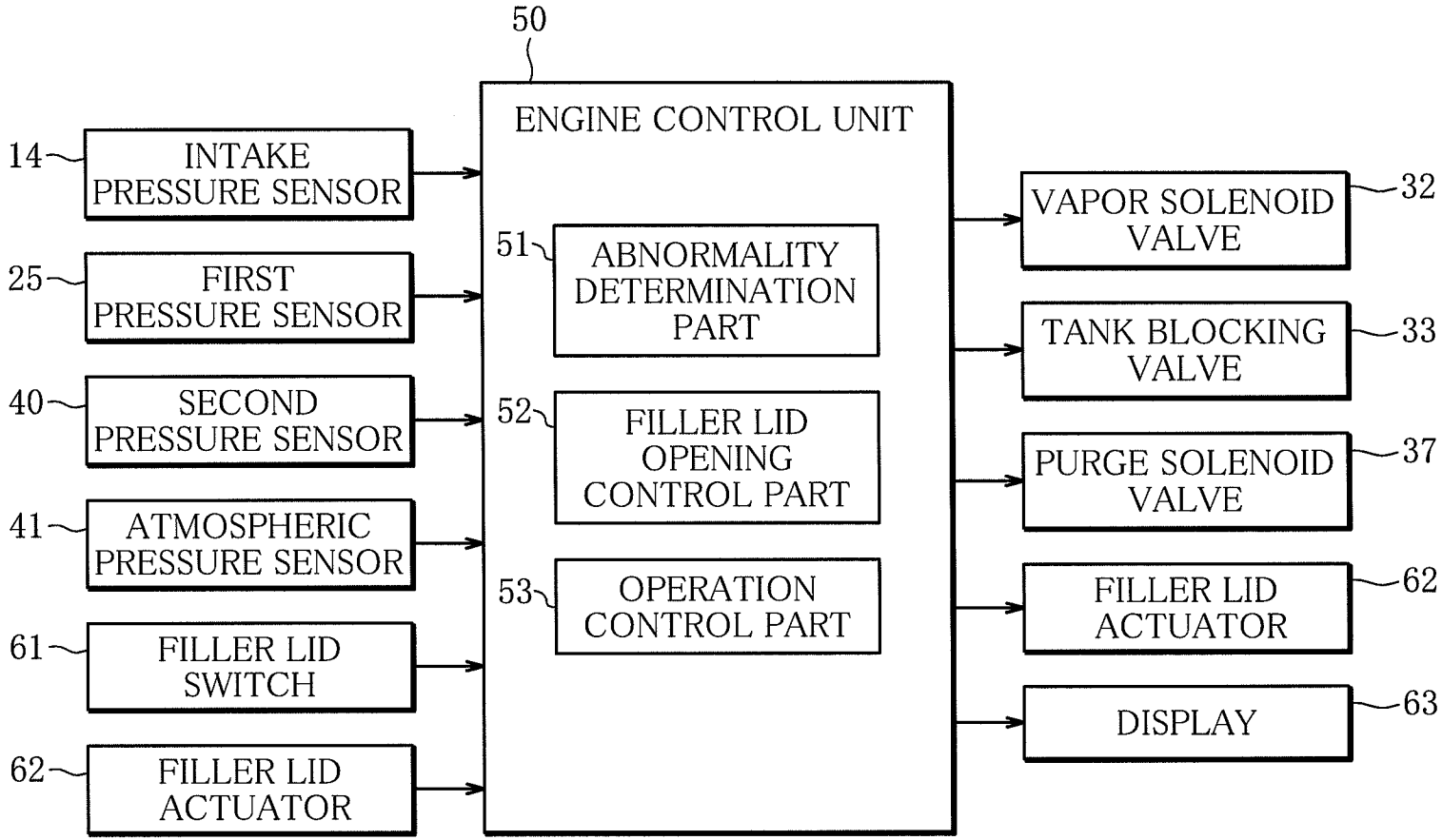
FIG. 2 is a block diagram of a fuel tank system in accordance with the present invention.

FIG. 1 is a schematic configuration diagram of a fuel tank system in accordance with the present invention. FIG. 2 is a block diagram of a fuel tank system in accordance with the present invention. Hereinafter, a configuration of a fuel tank system in accordance with the present invention will be described.

As shown in FIG. 1, a fuel tank system in accordance with the present invention broadly comprises: an engine 10 mounted on a vehicle; a fuel containing unit 20 that contains fuel; a fuel evaporative emission treatment unit 30; an engine control unit (corresponding to the second pressure detector, the abnormality determination part, the filler lid opening control part, and the operation control part, of the present invention) 50; a momentary filler lid switch 61 and a filler lid actuator (corresponding to the filler lid opening control part of the present invention) 62, which operate an opening operation of a filler lid 23 of the vehicle; and a display 63 that displays a state of the vehicle and the like.

The fuel evaporative emission treatment unit 30 treats a fuel evaporative emission (evaporation gas of fuel) formed by evaporation in the fuel containing unit 20.

The engine control unit 50 is a control device for performing overall control of the vehicle, and includes an input-output device, a storage device (ROM, RAM, non-volatile RAM, and the like), a central processing unit (CPU), and the like.

The engine 10 is a four-cycle in-line four-cylinder type gasoline engine of an air intake passage injection type (Multi Point Injection: MPI). The engine 10 is provided with an air intake passage 11 for taking air into a combustion chamber of the engine 10, and the air intake passage 11 is provided with an intake pressure sensor 14 for detecting internal pressure of the air intake passage 11. In addition, the air intake passage 11 is provided in its downstream with a fuel injection valve 12 for injecting fuel into an intake port of the engine 10. A fuel piping 13 is connected to the fuel injection valve 12 so that the fuel is supplied. The engine 10 is not limited to an air intake passage injection type, but may be an in-cylinder injection type, for example.

The fuel containing unit 20 includes: a fuel tank 21 for containing fuel; a filling opening 22 (corresponding to the filling opening of the present invention) which is a fuel inlet to the fuel tank 21; the filler lid 23; a fuel pump 24 for supplying the fuel to the fuel injection valve 12 from the fuel tank 21 through the fuel piping 13; a first pressure sensor (first pressure detector) 25; a fuel cutoff valve 26; a leveling valve 27 for controlling a liquid level in the fuel tank 21 at the time of filling; a two-way valve 28; and a fuel amount detector for detecting a fuel amount in the fuel tank 21, which is not shown. In addition, a fuel evaporative emission occurring in the fuel tank 21 is discharged from a lower portion of the leveling valve 27 to the outside of the fuel tank 21, or from the fuel cutoff valve 26 to the outside of the fuel tank 21 through the two-way valve 28 and the leveling valve 27.

A fuel cutoff valve 26 is provided in its inside with a float valve that is not shown, and prevents the fuel from flowing to the fuel evaporative emission treatment unit 30 from the fuel tank 21 by using an operation of the float valve.

A two-way valve 28 is provided with an orifice (ϕ1.0 mm, for example) with an inner diameter smaller than an inner diameter of piping such as vapor piping 38 and purge piping 39, which will be described later, and restricts filling in a state where the fuel tank 21 is filled up with fuel, or restricts an amount of fuel to be refilled.

The filler lid 23 is a lid of the filling opening 22 provided on a vehicle body of the vehicle.

The first pressure sensor 25 can detect pressure more finely than the second pressure sensor 40. Particularly, the first pressure sensor 25 has a property capable of detecting pressure in a narrow pressure range with a high accuracy (a measurement range of ±10 kPa, and a measurement accuracy of ±0.1 kPa, for example) to accurately detect pressure near the atmospheric pressure with respect to a property of the second pressure sensor 40. The first pressure sensor 25 is arranged in the fuel tank 21 to directly detect a pressure difference between an absolute internal pressure of the fuel tank 21 (corresponding to the internal pressure of the fuel tank of the present invention) and the atmospheric pressure, that is, a first tank internal pressure P1 which is a gauge pressure of the internal pressure of the fuel tank 21.

The fuel evaporative emission treatment unit 30 comprises: a canister 31; a vapor solenoid valve 32; a tank blocking valve (blocking valve) 33; a safety valve 34; an air filter 35; a purge solenoid valve 37; vapor piping (piping) 38; purge piping 39; a second pressure sensor (corresponding to the second pressure detector of the present invention) 40; and an atmospheric pressure sensor (corresponding to the second pressure detector of the present invention) 41.

The canister 31 is provided in its inside with activated carbon. In addition, the canister 31 is provided with an evaporative emission circulation hole 31*a* in which a fuel evaporative emission occurring in the fuel tank 21 or a fuel evaporative emission absorbed in the activated carbon circulates. Further, the canister 31 is provided with an outside air suction hole 31*b* through which outside air is sucked when the fuel evaporative emission absorbed in the activated carbon is discharged. The outside air suction hole 31*b* is connected to an air filter 35 provided with its one side opened to the atmosphere to prevent dusts from entering from the outside, so as to communicate with the other side of the air filter 35.

The vapor solenoid valve 32 is provided with a canister connection port 32*a* that is connected to the evaporative emission circulation hole 31*a* of the canister 31 so as to communicate therewith. In addition, the vapor solenoid valve 32 includes a vapor piping connection port 32*b* to which the vapor piping 38, whose one end is connected to the leveling valve 27 of the fuel tank 21 so as to communicate therewith, is connected so that the other end of the vapor piping 38 communicates with the vapor piping connection port 32*b*, and a purge piping connection port 32*c* to which the purge piping 39, whose one end is connected to the air intake passage 11 of the engine 10 so as to communicate therewith, is connected so that the other end of the purge piping 39 communicates with the purge piping connection port 32*c*. The vapor piping connection port 32*b* and the purge piping connection port 32*c* of the vapor solenoid valve 32 are connected to the vapor piping 38 and the purge piping 39, respectively. The vapor solenoid valve 32 is an electromagnetic valve of a normally closed type, which is closed in a nonenergized state and becomes a valve-open state by being energized with a driving signal supplied from the outside. When the vapor solenoid valve 32 is in a valve-open state by being energized with a driving signal supplied from the outside, the canister connection port 32*a*, the vapor piping connection port 32*b*, and the purge piping connection port 32*c* communicate with each other to enable an inflow and an outflow of a fuel evaporative emission to the canister 31 and an inflow of the air sucked from the air filter 35 to the vapor piping 38 and the purge piping 39. In addition, when the vapor solenoid valve 32 is in a valve-closed state in a nonenergized state, the canister connection port 32*a* is blocked to allow only the vapor piping connection port 32*b* and the purge piping connection port 32*c* to communicate with each other to disable an inflow and an outflow of a fuel evaporative emission to the canister 31 and an inflow of the air sucked from the air filter 35 to the vapor piping 38 and the purge piping 39. Thus, the vapor solenoid valve 32 blocks the canister 31 if in a valve-closed state, and opens the canister 31 if in a valve-open state.

The tank blocking valve 33 is provided in the vapor piping 38 between the leveling valve 27 arranged in the fuel tank 21, and the canister 31. The tank blocking valve 33 is an electromagnetic valve of a normally closed type, which is closed in a nonenergized state and becomes a valve-open state by being energized with a driving signal supplied from the outside. The tank blocking valve 33 blocks the vapor piping 38 when in a valve-closed state in a nonenergized state, and opens the vapor piping 38 when in a valve-open state by being energized with a driving signal supplied from the outside. Thus, the tank blocking valve 33 blocks the fuel tank 21 in a closed state if in a valve-closed state to disable an outflow of a fuel evaporative emission occurring in the fuel tank 21 to the outside of the fuel tank 21, and the tank blocking valve 33 enables an inflow of the fuel evaporative emission to the canister 31 if in a valve-open state.

The safety valve 34 is provided in the vapor piping 38 in parallel to the tank blocking valve 33, and if internal pressure of the fuel tank 21 rises, the safety valve 34 is opened to release the pressure to the canister 31, thereby preventing the fuel tank 2 from bursting.

The purge solenoid valve 37 is provided in the purge piping 39 between the air intake passage 11 of the engine 10, and the vapor solenoid valve 32. The purge solenoid valve 37 is an electromagnetic valve of a normally closed type, which is closed in a nonenergized state and becomes a valve-open state by being energized with a driving signal supplied from the outside. In addition, the purge solenoid valve 37 blocks the purge piping 39 if in a valve-closed state in a nonenergized state, and opens the purge piping 39 if in a valve-open state being energized with a driving signal supplied from the outside. Thus, the purge solenoid valve 37 disables an outflow of a fuel evaporative emission from the fuel evaporative emission treatment unit 30 to the engine 10 if in a valve-closed state, and enables an outflow of the fuel evaporative emission to the engine 10 if in a valve-open state.

The second pressure sensor 40 is the sensor that can detect pressure wider than the first pressure detection part. In particular, the second pressure sensor 40 has a property capable of detecting pressure in a wide pressure range with a low accuracy (a measurement range of ±100 kPa, and a measurement accuracy of ±5 kPa, for example) with respect to the property of the first pressure sensor 25. The second pressure sensor 40 is provided in the vapor piping 38 between the fuel tank 21 and the tank blocking valve 33 to detect internal pressure (absolute pressure) of the fuel tank 21 through the vapor piping 38.

The atmospheric pressure sensor 41 has a property capable of detecting pressure in a wide pressure range with a low accuracy with respect to the property of the first pressure sensor 25, and the atmospheric pressure sensor 41 is provided at a position capable of detecting the atmospheric pressure to detect the atmospheric pressure.

The filler lid actuator 62 fixes the filler lid 23 closed so that the filler lid 23 is not opened, and releases fixing of the filler lid 23 on the basis of a signal from an engine control unit 50 to enable the filler lid 23 to be opened. Thus, under usual conditions, the filler lid 23 is opened when fixing by the filler lid actuator 62 is released on the basis of a signal supplied from the engine control unit 50, and under unusual conditions, it is possible to open the filler lid 23 by allowing a driver and the like to mechanically operate the filler lid actuator 62 to release fixing of the filler lid 23 by the filler lid actuator 62. In addition, the filler lid actuator 62 is provided with a sensor for detecting opening/closing of the open of the filler lid 23.

A display 63 indicates a vehicle state, such as a state from an operation of a filler lid switch 61 until the filler lid 23 is opened, that is, indicates a meter in which a progress degree of pressure release in the fuel tank 21, representing a progress degree of pressure reduction in the fuel tank 21 from a start of releasing internal pressure of the fuel tank 21 to a finish thereof, is indicated stepwise. The display 63 also indicates warning if it is determined that there is abnormality in any one of the first pressure sensor 25 and the second pressure sensor 40 in sensor abnormality determination at the time of performing filler lid opening control, which will be described later, and indicates a stop of an opening operation of the filler lid 23.

The engine control unit 50 is a control device for performing overall control of a vehicle. The engine control unit 50 includes an input-output device, a storage device (ROM, RAM, nonvolatile RAM, and the like), a central processing unit (CPU), a timer, and the like.

As shown in FIG. 2, on an input side of the engine control unit 50, there are connected the intake pressure sensor 14, the first pressure sensor 25, the second pressure sensor 40, the atmospheric pressure sensor 41, the filler lid switch 61 for opening and closing the filler lid 23 provided in a vehicle, and the filler lid actuator 62 for detecting opening/closing of the filler lid 23, described above, whereby detection information from these sensors is inputted into the engine control unit 50.

On the other hand, on an output side of the engine control unit 50, there are connected the fuel injection valve 12, the fuel pump 24, the vapor solenoid valve 32, the tank blocking valve 33, the purge solenoid valve 37, the filler lid actuator 62, and the display 63, described above.

The engine control unit 50 includes an abnormality determination part 51, a filler lid opening control part 52, and an operation control part 53.

The abnormality determination part 51 determines abnormality of the first pressure sensor 25 and the second pressure sensor 40 on the basis of a change rate of a first tank internal pressure P1 detected by the first pressure sensor 25 and a second tank internal pressure P2 which is a difference between internal pressure of the fuel tank 21 detected by the second pressure sensor 40 and the atmospheric pressure detected by the atmospheric pressure sensor 41.

The filler lid opening control part 52 controls opening of the filler lid 23 when the filling opening of the fuel tank 21 is opened, that is, the filler lid 23 of the vehicle is opened, on the basis of a detection result obtained by the first pressure sensor 25.

The operation control part 53 controls an operation of the tank blocking valve 33, and allows the tank blocking valve 33 to open if the second tank internal pressure P2 becomes a predetermined pressure or more at which abnormality may occur in the fuel containing unit 20 of the fuel tank system while the engine 10 is operating.

The engine control unit 50, on the basis of detection information from various sensors, controls the following: an operation of the filler lid 23; opening/closing of each of the vapor solenoid valve 32, the tank blocking valve 33, and the purge solenoid valve 37; pressure in the fuel tank 21, and in the vapor piping 38 and the purge piping 39, provided between the tank blocking valve 33 and the purge solenoid valve 37; and a flow of a fuel evaporative emission such as absorption of a fuel evaporative emission into the canister 31, and an outflow of the fuel evaporative emission absorbed into the canister 31 to the air intake passage 11 of the engine 10. Particularly, when the engine 10 is stopped, the engine control unit 50 closes the tank blocking valve 33 to allow the fuel tank 21 to be in a closed state, and when a driver operates the filler lid switch 61 for filling a vehicle or the like, the engine control unit 50 opens the tank blocking valve 33 to release internal pressure of the fuel tank 21 so that a fuel evaporative emission in the fuel tank 21 is guided into the canister 31. In addition, when internal pressure of the fuel tank 21 becomes equivalent to the atmospheric pressure, that is, the first tank internal pressure P1 becomes the atmospheric pressure, filler lid opening control is performed to open the filler lid 23 by releasing fixing of the filler lid 23 by the filler lid actuator 62. The engine control unit 50 performs sensor abnormality determination when performing the filler lid opening control, to determine abnormality of the first pressure sensor 25 and the second pressure sensor 40 on the basis of a change rate of a first tank internal pressure P1 detected by the first pressure sensor 25 and a second tank internal pressure P2 which is a difference between the internal pressure of the fuel tank 21 detected by the second pressure sensor 40 and the atmospheric pressure detected by the atmospheric pressure sensor 41. If it is determined that there is abnormality in any one of the first pressure sensor 25 and the second pressure sensor 40 in the sensor abnormality determination, the filler lid 23 is not opened by the filler lid opening control as well as warning is indicated on the display 63. In addition, the engine control unit 50 opens the tank blocking valve 33 if the second tank internal pressure P2 becomes so high (corresponding to a predetermined pressure of the present invention) that abnormality may occur in the fuel containing unit 20 of the fuel tank system while the engine 10 is operating.

Hereinafter, filler lid opening control in the engine control unit 50 of the fuel tank system in accordance with the present invention, configured as above, will be described.

Figure 3:
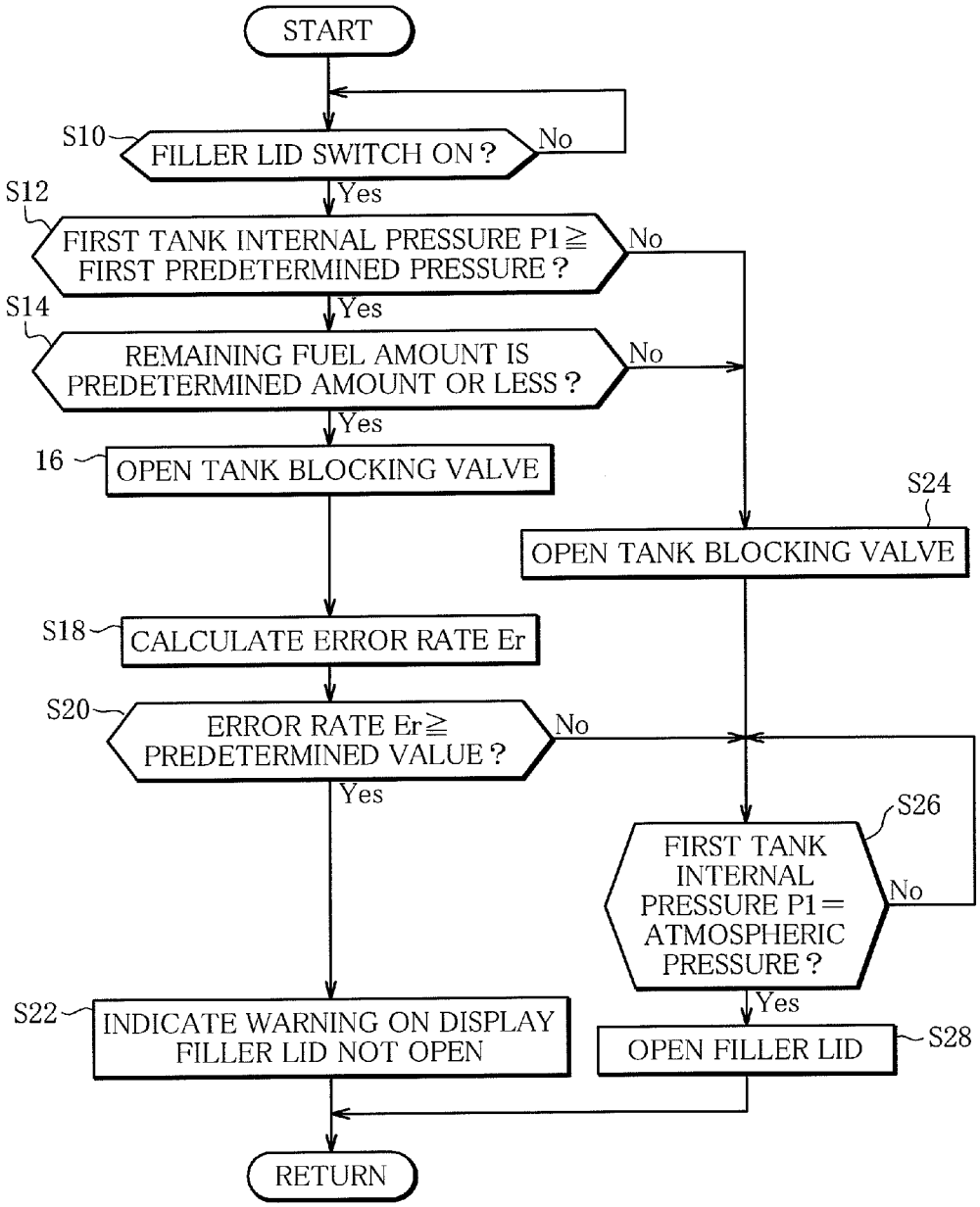
FIG. 3 is a flow chart of filler lid opening control of a fuel tank system in accordance with the present invention.
Figure 4:
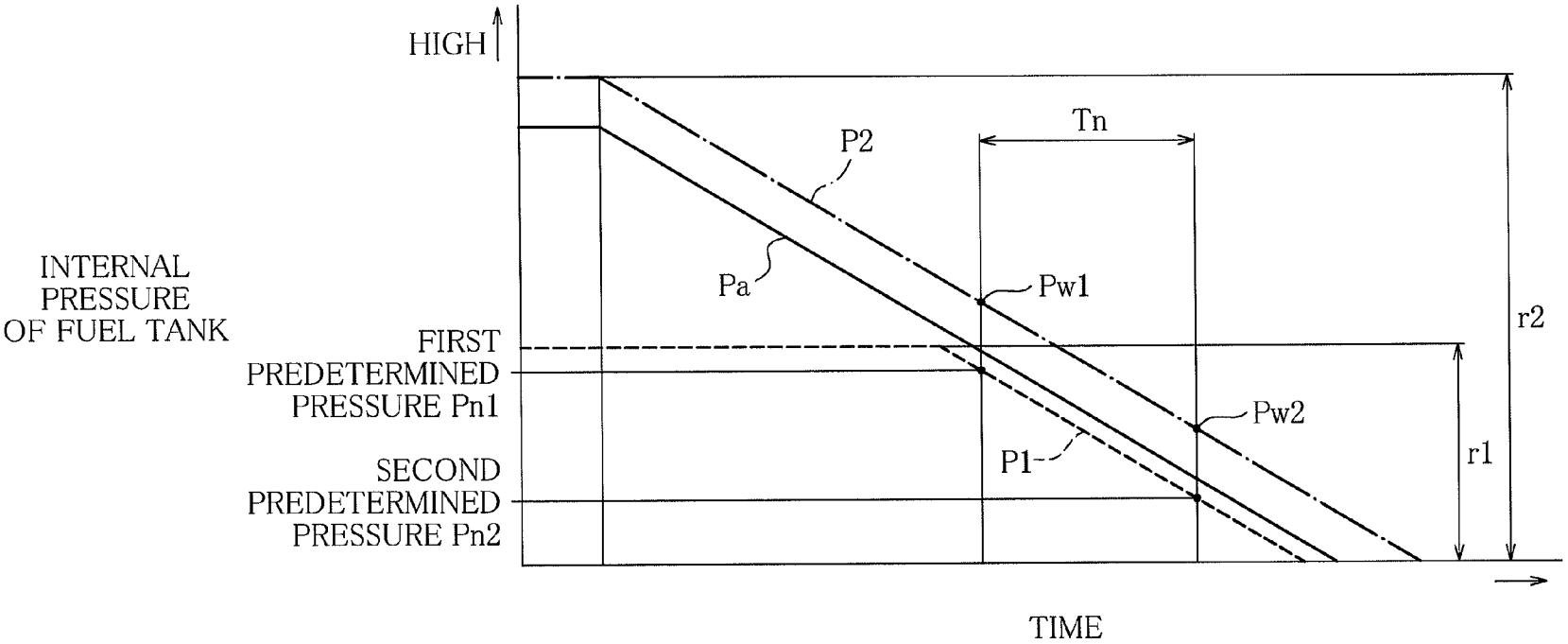
FIG. 4 shows an example of changes in an actual internal pressure of the fuel tank, a detection value obtained by the first pressure sensor, and a detection value obtained by the second pressure sensor at the time of performing the filler lid opening control in time series.

FIG. 3 is a flow chart of filler lid opening control of a fuel tank system in accordance with the present invention, and FIG. 4 shows an example of changes in an actual internal pressure of the fuel tank, a detection value obtained by the first pressure sensor, and a detection value obtained by the second pressure sensor at the time of performing the filler lid opening control in time series. In FIG. 4, internal pressure of the fuel tank 21 is indicated on a vertical axis, and time is indicated on a horizontal axis, and also in FIG. 4, a solid line shows an actual tank internal pressure Pa, which is an actual internal pressure of the fuel tank 21, a broken line shows a first tank internal pressure P1, which is an internal pressure of the fuel tank 21 detected by the first pressure sensor 25, and a dashed line shows a second tank internal pressure P2, which is a difference between the internal pressure of the fuel tank 21 detected by the second pressure sensor 40 and the atmospheric pressure detected by the atmospheric pressure sensor 41. In addition, in FIG. 4, Tn designates a period in which the first tank internal pressure P1 changes from a first predetermined pressure Pn1 to a second predetermined pressure Pn2, r1 designates a range of pressure in which the first pressure sensor 25 can measure pressure, and r2 designates a range of pressure in which the second pressure sensor 40 can measure pressure. Further, in FIG. 4, Pw1 designates the second tank internal pressure P2 at a time when the first tank internal pressure P1 becomes the first predetermined pressure Pn1, and Pw2 designates the second tank internal pressure P2 at a time when the first tank internal pressure P1 becomes the second predetermined pressure Pn2.

As shown in FIG. 3, in a step S10, it is determined whether the filler lid switch 61 is turned on, that is, the filler lid switch 61 is operated. If the determination result is true (Yes), and the filler lid switch 61 has been turned on, that is, the filler lid switch 61 has been operated, processing proceeds to a step S12. If the determination result is nay (No), and the filler lid switch 61 has not been turned on, and the filler lid switch 61 has not been operated, the step S10 is performed again. Thus, the open control of the filler lid is started by the operation of the filler lid switch 61 as a trigger.

In the step S12, it is determined whether the first tank internal pressure P1 is equal to or more than the first predetermined pressure Pn1. Particularly, it is determined whether the first tank internal pressure P1, which is the internal pressure of the fuel tank 21 detected by the first pressure sensor 25, is equal to or more than the first predetermined pressure Pn1. If the determination result is true (Yes), and the first tank internal pressure P1 is equal to or more than the first predetermined pressure Pn1, processing proceeds to a step S14. If the determination result is nay (No), and the first tank internal pressure P1 is not equal to or more than the first predetermined pressure Pn1, the processing proceeds to a step S24.

In the step S14, it is determined whether the amount of remaining fuel is equal to or less than a predetermined value. Particularly, it is determined whether the amount of remaining fuel in the fuel tank 21 is equal to or less than the predetermined value (an amount of the fuel in which a leveling valve 27 is not soaked, for example). If the determination result is true (Yes), and the amount of remaining fuel is equal to or less than the predetermined value, processing proceeds to a step S16. If the determination result is nay (No), and the amount of remaining fuel is not equal to or less than the predetermined value, the processing proceeds to a step S24.

In the step S16, the tank blocking valve 33 is opened so as to release internal pressure of the fuel tank 21, and processing proceeds to a step S18.

In the step S18, an error rate Er is calculated. Particularly, a change rate ΔPw in a period Tn in which the first tank internal pressure P1 changes from the first predetermined pressure Pn1 to the second predetermined pressure Pn2 is calculated on the basis of Expression (1) below.

$$\Delta Pw=(Pn2-Pn1)/Tn \quad (1)$$

Next, a change rate ΔPn of the second tank internal pressure P2 in the period Tn is calculated on the basis of: the second tank internal pressure Pw1 at the time of the first predetermined pressure Pn1, which is the second tank internal pressure P2 when the first tank internal pressure P1 has become the first predetermined pressure Pn1; the second tank internal pressure Pw2 at the time of the second predetermined pressure Pn2, which is the second tank internal pressure P2 when the first tank internal pressure P1 has become the second predetermined pressure Pn2; the period Tn in which the first tank internal pressure P1 changes from the first predetermined pressure Pn1 to the second predetermined pressure Pn2; and Expression (2) below.

$$\Delta Pn=(Pw2-Pw1)/Tn \quad (2)$$

In addition, an error rate (corresponding to an error of the present invention) Er between the change rate ΔPw of the first tank internal pressure P1 and the change rate ΔPn of the second tank internal pressure P2 is calculated on the basis of Expression (3) below, and processing proceeds to a step S20.

$$Er=|(\Delta Pw-\Delta Pn)/\Delta Pn\times 100 \quad (3)$$

In the step S20, it is determined whether the error rate Er is equal to or more than a predetermined value. Particularly, it is determined whether the error rate Er calculated in the step S18 is equal to or more than the predetermined value. If the determination result is true (Yes), and the error rate Er is equal to or more than the predetermined value, processing proceeds to a step S22. If the determination result is nay (No), and the error rate Er is not equal to or more than the predetermined value, the processing proceeds to a step S26.

In the step S22, warning is indicated on the display 63 so that the filler lid 23 is not opened, and this routine is returned.

On the other hand, in the step S24, the tank blocking valve 33 is opened so as to release internal pressure of the fuel tank 21, and processing proceeds to the step S26.

In the step S26, it is determined whether the first tank internal pressure P1 has become the atmospheric pressure. Particularly, it is determined whether the pressure in the fuel tank 21 has become the atmospheric pressure, and whether the first tank internal pressure P1, which is the internal pressure of the fuel tank 21 detected by the first pressure sensor 25, has become 0 (zero). If the determination result is true (Yes), and the pressure in the fuel tank 21 has become the atmospheric pressure and the first tank internal pressure P1, which is the internal pressure of the fuel tank 21 detected by the first pressure sensor 25, has become 0 (zero), processing proceeds to a step S28. If the determination result is nay (No), and the first tank internal pressure P1 has not become 0 (zero), the processing of the step S26 is performed again.

In a step S30, the filler lid 23 is opened, and this routine is returned.

As above, in the fuel tank system in accordance with the present invention, abnormality of the first pressure sensor 25 and the second pressure sensor 40 is determined on the basis of the error rate Er between the change rate ΔPw of the first tank internal pressure P1 and the change rate ΔPn of the second tank internal pressure P2 during the filler lid opening control. It is possible to detect abnormality of both of the first pressure sensor 25 and the second pressure sensor 40 with a simple structure by monitoring abnormality of both of the first pressure sensor 25 and the second pressure sensor 40 on the basis of a detection result obtained by the first pressure sensor 25 and a detection result obtained by the second pressure sensor 40.

In addition, the second pressure sensor 40 is arranged in the vapor piping 38 between the fuel tank 21 and the tank blocking valve 33 so that the second pressure sensor 40 is arranged in a position different from a position of the first pressure sensor 25. As a result, pressure in the fuel tank 21 can be detected when the tank blocking valve 33 is closed, and pressure in the vapor piping 38 can be detected when the tank blocking valve 33 is opened, whereby it is possible to use a detection result obtained by the second pressure sensor 40 for other failure detection.

The first pressure sensor 25 capable of detecting pressure in a narrow pressure range with a high accuracy is arranged in the fuel tank 21 to detect internal pressure of the fuel tank 21, and the second pressure sensor 40 capable of detecting pressure in a wide pressure range with a low accuracy with respect to the first pressure sensor 25 is arranged in the vapor piping 38 between the fuel tank 21 and the tank blocking valve 33 to detect internal pressure of the fuel tank 21. When the filler lid switch 61 is operated to open the fuel filling opening 22 of the fuel tank 21 for filling and the like, and internal pressure of the fuel tank 21 is released, the first pressure sensor 25 capable of detecting pressure in a narrow pressure range with a high accuracy detects internal pressure of the fuel tank 21, and an operation of the tank blocking valve 33 is controlled on the basis of the detection result. When the internal pressure of the fuel tank 21 has become the atmospheric pressure and the first tank internal pressure P1, which is the internal pressure of the fuel tank 21 detected by the first pressure sensor 25, has become 0 (zero), the filler lid 23 is opened. As a result, it is possible to accurately reduce internal pressure of the fuel tank 21 down to near the atmospheric pressure before the filler lid 23 is opened, whereby it is possible to prevent a fuel evaporative emission in the fuel tank 21 from being discharged from the fuel filling opening 22 of the fuel tank 21. In a case where the second tank internal pressure P2 is so high that abnormality may occur in the fuel containing unit 20 of the fuel tank system while the engine 10 is operating, it is possible to reduce internal pressure of the fuel tank 21 down to a pressure at which occurrence of abnormality is reliably avoided in the fuel tank system by controlling an operation of the tank blocking valve 33 on the basis of the second tank internal pressure P2.

Therefore, since the first pressure sensor 25 capable of detecting pressure in a narrow pressure range with a high accuracy and the second pressure sensor 40 capable of detecting pressure in a wide pressure range with a low accuracy with respect to the first pressure sensor 25 are provided, it is unnecessary to use a pressure detection part capable of detecting pressure in a wide pressure range with a high accuracy, whereby an increase in cost can be prevented and it is possible to accurately detect pressure in a narrow pressure range and to detect pressure in a wide pressure range.

What is claimed is:

1. A fuel tank system comprising:

a fuel tank mounted on a vehicle;

a first pressure detector arranged in the fuel tank to detect pressure in the fuel tank;

a second pressure detector arranged in a position different from the position of the first pressure detector to detect pressure in the fuel tank; and an abnormality determination part that determines abnormality in the first pressure detector or the second pressure detector on the basis of a detection result obtained by the first pressure detector and a detection result obtained by the second pressure detector.

2. The fuel tank system according to claim 1, further comprising:

a canister that absorbs a fuel evaporative emission released from the fuel tank;

piping that connects the canister and the fuel tank; and a blocking valve that is provided in the piping to block the fuel tank, wherein the second pressure detector is arranged in the piping between the fuel tank and the blocking valve.

3. The fuel tank system according to claim 2, further comprising:

a filler lid that is provided in the vehicle and closes a filling opening of the fuel tank;

a filler lid opening control part that controls opening of the filler lid; and an operation control part that controls an operation of the blocking valve, wherein the filler lid opening control part opens the filler lid on the basis of a detection result obtained by the first pressure detector when the filling opening of the fuel tank is opened, and the operation control part controls the operation of the blocking valve on the basis of a detection result obtained by the second pressure detector when the pressure in the fuel tank is equal to or higher than a predetermined pressure.

4. The fuel tank system according to claim 1, wherein the second pressure detector is a sensor capable of detecting pressure in a wider range than the first pressure detector, and the first pressure detector is a sensor capable of detecting pressure more finely than the second pressure detector.

5. The fuel tank system according to claim 2, wherein the second pressure detector is a sensor capable of detecting pressure in a wider range than the first pressure detector, and the first pressure detector is a sensor capable of detecting pressure more finely than the second pressure detector.

6. The fuel tank system according to claim 3, wherein the second pressure detector is a sensor capable of detecting pressure in a wider range than the first pressure detector, and the first pressure detector is a sensor capable of detecting pressure more finely than the second pressure detector.

7. The fuel tank system according to claim 1, wherein the abnormality determination part determines that there is abnormality in the first pressure detector or the second pressure detector in a case where a detection result obtained by the first pressure detector and a detection result obtained by the second pressure detector are compared, and an error between the detection results is equal to or more than a predetermined value.

8. The fuel tank system according to claim 2, wherein the abnormality determination part determines that there is abnormality in the first pressure detector or the second pressure detector in a case where a detection result obtained by the first pressure detector and a detection result obtained by the second pressure detector are compared, and an error between the detection results is equal to or more than a predetermined value.

9. The fuel tank system according to claim 3, wherein the abnormality determination part determines that there is abnormality in the first pressure detector or the second pressure detector in a case where a detection result obtained by the first pressure detector and a detection result obtained by the second pressure detector are compared, and an error between the detection results is equal to or more than a predetermined value.

10. The fuel tank system according to claim 4, wherein the abnormality determination part determines that there is abnormality in the first pressure detector or the second pressure detector in a case where a detection result obtained by the first pressure detector and a detection result obtained by the second pressure detector are compared, and an error between the detection results is equal to or more than a predetermined value.

11. The fuel tank system according to claim 5, wherein the abnormality determination part determines that there is abnormality in the first pressure detector or the second pressure detector in a case where a detection result obtained by the first pressure detector and a detection result obtained by the second pressure detector are compared, and an error between the detection results is equal to or more than a predetermined value.

12. The fuel tank system according to claim 6, wherein the abnormality determination part determines that there is abnormality in the first pressure detector or the second pressure detector in a case where a detection result obtained by the first pressure detector and a detection result obtained by the second pressure detector are compared, and an error between the detection results is equal to or more than a predetermined value.

* * * * *